United States Patent [19]

Kushner

[11] Patent Number: 4,588,655

[45] Date of Patent: May 13, 1986

[54] CERAMIC FLAME SPRAY POWDER

[75] Inventor: Burton A. Kushner, Old Bethpage, N.Y.

[73] Assignee: Eutectic Corporation, Flushing, N.Y.

[21] Appl. No.: 608,267

[22] Filed: May 7, 1984

Related U.S. Application Data

[62] Division of Ser. No. 388,263, Jun. 14, 1982, abandoned.

[51] Int. Cl.[4] ..... C03C 27/02; B05D 1/10

[52] U.S. Cl. ..... 428/633; 428/937; 427/423; 501/105

[58] Field of Search ..... 501/105; 427/423; 428/937, 621, 630, 633

[56] References Cited

U.S. PATENT DOCUMENTS

| | | | |
|---|---|---|---|
| 3,419,414 | 12/1968 | Marks | 428/937 X |
| 4,248,940 | 2/1981 | Goward | 427/423 X |
| 4,335,190 | 6/1982 | Bill et al. | 427/423 |
| 4,421,799 | 12/1983 | Novinski | 427/423 |

*Primary Examiner*—Shrive P. Beck

*Attorney, Agent, or Firm*—Hopgood, Calimafde, Kalil, Blaustein & Judlowe

[57] ABSTRACT

A flame spray ceramic powder is provided consisting essentially of about 10 to 50% alumina and the balance essentially zirconia. Preferably, the zirconia is stabilized. A method is disclosed for flame spraying the coating composition onto a metal substrate.

21 Claims, No Drawings

CERAMIC FLAME SPRAY POWDER

This application is a division of application Ser. No. 388,263, filed June 14, 1982, now abandoned.

This invention relates to ceramic flame spray powders and, in particular, to a flame spray powder comprised of alumina and zirconia for producing bonded coatings characterized by improved resistance to wear and improved hardness.

STATE OF THE ART

It is known to produce ceramic coatings by flame spraying. The term "flame spraying" employed herein is understood to include plasma spraying, oxyacetylene torch spraying, and the like. With respect to the production of ceramic coatings, plasma spraying is preferred in light of the high melting points of most ceramics.

In U.S. Pat. No. 2,876,121, zirconia per se is disclosed as a flame spray material in the form of zirconia rods. The zirconia preferably contains 3 to 6% CaO as a crystallographic stabilizer to assure substantially uniform contraction or expansion of the sprayed coating during heating and cooling of the coated material, thereby minimizing spalling.

One of the disadvantages of a flame sprayed zirconia coating is its lack of toughness, its relatively low range of hardness, and its resistance to wear. It would be desirable to provide a flame spray zirconia-containing composition in which the resulting coating has a higher hardness, improved resistance to spalling, and improved resistance to wear.

OBJECTS OF THE INVENTION

It is an object of the invention to provide a ceramic flame spray powder comprising a composition based on the system $ZrO_2$-$Al_2O_3$.

Another object is to provide a flame sprayed ceramic coating characterized by improved hardness, resistance to wear and toughness.

A further object is to provide a flame spray method for producing a bonded ceramic coating comprised of a composition based on the system $ZrO_2$-$Al_2O_3$.

These and other objects will more clearly appear when taken in conjunction with the following disclosure and the appended claims.

STATEMENT OF THE INVENTION

In its broad aspects, the flame spray powder of the invention comprises a composition of $Al_2O_3$ (alumina) and $ZrO_2$ (zirconia) in which the amount of $Al_2O_3$ ranges from about 10% to 50% and the balance substantially $ZrO_2$. The composition preferably ranges from about 20% to 40% $Al_2O_3$ and the balance substantially $ZrO_2$. One of the advantages of using $Al_2O_3$ in the aforementioned composition range is its effect on improving toughness of the coating.

Another advantage of employing $Al_2O_3$ is that it can be used with unstabilized $ZrO_2$, partially stabilized $ZrO_2$, or fully stabilized $ZrO_2$, although stabilized $ZrO_2$ is preferred. A particularly preferred composition is one containing about 20 to 28% $Al_2O_3$ and substantially the balance CaO-stabilized zirconia (e.g., 5% CaO-bal. zirconia).

A problem with ceramic coatings is its limitation on thickness. At a certain thickness level, there is a tendency for relatively thick coatings on a metal substrate to crack due to the difference in the coefficient of expansion or contraction. According to the invention, thicknesses in excess of 0.1 inch are possible. Apparently, such thicknesses resist cracking or spalling due to the presence of stress-relieving microcracks in the coating.

Moreover, the coating is tougher and stronger than coatings of zirconia per se which is believed due to eutectic or solid solution reactions of $Al_2O_3$ with $ZrO_2$.

Ceramic compositions based on $ZrO_2$-$Al_2O_3$ are known. In this connection, reference is made to U.S. Pat. No. 2,271,369 which is directed to refractory zirconia-alumina castings. In this patent, a binary curve is shown of the $ZrO_2$-$Al_2O_3$ system in which a minimum melting point is indicated at about 45% to 55% $Al_2O_3$ in the neighborhood of 1900° C., zirconia per se having a substantially higher melting point of about 2700° C. There is no teaching in this patent of flame spray coatings or the problems which arise in plasma sprayed coatings involving relatively high cooling rates of the coating due to the very high superheat of the plasma flame and the substantially high quenching effect of the relatively cooled metal substrate on the deposited coating, even when the substrate is preheated prior to flame spraying.

DETAILS OF THE INVENTION

As stated hereinabove, alumina has a strengthening effect on zirconia over the range of about 10% to 50% $Al_2O_3$. A specific composition is 70% by weight of lime-stabilized zirconia and the balance substantially 30% by weight of alumina. The crystal structure of the sprayed deposit indicates a cubic structure, which is the stabilized form of zirconia which is normally monoclinic.

However, it is believed that the thermal shock resistance of the $ZrO_2$-$Al_2O_3$ composition is due to a partially stabilized phase containing the tetragonal system with the strengthening effect due to the alumina addition by means of the eutectic or solid solution reactions.

Various known methods may be employed for producing the powder compositions, the methods including: (1) spray drying of a uniform slurry of the two powders, (2) agglomeration using binders, e.g., resin binders, and (3) a fused mixture of the powders, following which the fused mixture is ground to the desired size.

As illustrative of spray drying, reference is made to U.S. Pat. Nos. 1,601,898, 3,373,119, 3,429,962, and 3,617,358, among others, the disclosures of these patents being incorporated herein by reference.

One technique of agglomerating the powder mixture is disclosed in U.S. Pat. No. 4,230,747, reference being made to column 5, the disclosure of which is incorporated herein by reference. In producing an agglomerate of the $ZrO_2$-$Al_2O_3$ mixture, a uniform mixture of the powders of appropriate particle size is mixed in the proper amount with a fugitive bonding agent, such as a resin, or other adhesive, e.g., alkali metal silicate. The particle size may range, for example, from about 0.5 to 10 microns. However, the particle size need not be limited to this range. One example of a fugitive binder is methyl methacrylate dissolved in methyl ethyl ketone. The amount of resin employed corresponds on a dry basis with respect to the powder mixture of about 2% to 3% by weight following evaporation of the solvent. Broadly speaking, the amount of binder on the dry basis may range from about 1% to 5% of the total weight of the ingredients being agglomerated. Examples of other resins and solvents are given in column 5 of U.S. Pat. No. 4,230,747.

The mixing and agglomeration may be carried out in a Hobart mixer manufactured by the Hobart Manufacturing Company of Troy, Ohio. Another type mixer is one referred to as the Ross Mixer. During mixing, the solvent evaporates leaving behind bonded agglomerates which are sized by passing the agglomerates through a screen of, for example, 100 mesh and preferably through 140 mesh, or other desirable mesh size, e.g., −270 mesh (U.S. Standard).

Typical substrates to which the ceramic coating is applied are ferrous metal substrates, such as mild steel, for example, steels containing 0.05 to 0.3% carbon by weight (e.g., 0.1 to 0.2%). Typical steels are 1010 and 1020 steels. Other ferrous metal substrates may comprise low alloy and medium alloy steels. However, the ceramic coating may be applied to a variety of metal substrates, including cast iron.

In order to achieve consistently a good bond, an intermediate alloy bond coat is employed. Well-known alloy bond coats are disclosed in U.S. Pat. No. 4,202,691 and U.S. Pat. No. 3,322,515, among others.

One preferred bond coat is that obtained with an alloy powder containing 18 to 20% Cr, 4.5 to 7% Al, and the balance essentially nickel. The powder produces a strong bond when plasma sprayed on the metal substrate to which the ceramic powder strongly adheres when plasma sprayed onto the bond coat.

Another preferred bond coat powder for particular use in plasma spraying is an alloy of approximately 80% Ni and 20% Cr.

As illustrative of the invention, the following example is given:

EXAMPLE

Two tests were conducted, one using a ceramic composition of the invention, the other stabilized zirconia per se. The powder composition of the invention was a spray dried mixture comprising 75% stabilized zirconia and substantially the balance about 25% alumina, the particle size of the spray dried powder ranging from about 3 to 63 microns, for example, 5 to 53 microns. The zirconia powder was stabilized with 5% CaO.

Two mild steel substrates were cleaned of all surface oxides and a bond coat of an alloy powder of about 18–20% Cr, about 4.5–7% Al, and the balance essentially nickel was plasma sprayed on each substrate using a plasma spray gun identified as Metco 3MB. The bond coat was sprayed to a thickness of about 0.008 inch.

An example of a plasma flame spray gun is given in U.S. Pat. No. 3,304,402.

Following the application of the bond coat, the powder of the invention was plasma sprayed using the plasma gun referred to above, the thickness obtained being about 0.1 inch. Similarly, the powder outside the invention was flame sprayed to a thickness of about 0.08 inch. The following results were obtained:

TABLE 1

| | The Invention | Normal Stabilized $ZrO_2$ |
|---|---|---|
| Hardness | 55–60 $R_c$ | 40–45 $R_c$ |
| Spall Resistance | Excellent | Good |
| Coefficient of Friction | Low | Low |

The wear resistance of the coating of the invention was 30–50% better than the coating produced from stabilized $ZrO_2$ alone.

As will be clearly apparent, the coating of the invention is superior to the coating of stabilized $ZrO_2$ alone. X-ray diffraction studies indicate that $Al_2O_3$ combines with zirconia to strengthen the crystal lattice.

The alumina strengthens the composition whether or not the zirconia is stabilized. However, as stated earlier, it is preferred that the zirconia be stabilized. In addition to calcia (CaO), other stabilizers may be employed in amounts ranging up to about 20% by weight of the mixture of zirconia plus the stabilizer. Examples of such other stabilizers are neodymia, lanthana, yttria, and magnesia. The amounts employed should be at least sufficient to cause some stabilization.

Examples of ranges relative to the zirconia present would be about 5 to 20% neodymia, over 5 to 20% lanthana, about 6 to 20% yttria, about 4 to 8% calcia, and 2 to 4% magnesia.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A method of coating a metal substrate with an adherent layer of a ceramic composition which comprises, flame spraying an alloy bond coat on said substrate, and then flame spraying over said bond coat a ceramic composition consisting essentially by weight of about 10 to 50% alumina and the balance essentially zirconia, said composition being in the form of particles selected from the group consisting of spray dried particles, agglomerated resin-bonded particles and fused particles, whereby a bonded ceramic coating is produced characterized by improved resistance to spalling at thicknesses ranging up to about 0.1 inch and higher and further characterized by being stronger and tougher than flame sprayed coatings of stabilized zirconia alone.

2. The method of claim 1, wherein the amount of alumina in the ceramic composition ranges from about 20% to 40% by weight.

3. A method of coating a metal substrate with an adherent layer of a ceramic composition which comprises, flame spraying an alloy bond coat on said substrate, and then flame spraying a ceramic composition consisting essentially by weight of about 10% to 50% alumina and the balance essentially stabilized zirconia, said composition being in the form of particles selected from the group consisting of spray dried particles, agglomerated resin-bonded particles and fused particles, whereby a bonded ceramic coating is produced characterized by improved resistance to spalling at thicknesses ranging up to about 0.1 inch and higher and further characterized by being stronger and tougher than flame sprayed coatings of stabilized zirconia alone.

4. The method of claim 3, wherein the alumina ranges from about 20 to 40% of the total composition.

5. The method of claim 3, wherein the ceramic coating is produced on a ferrous metal substrate.

6. A method of coating a metal substrate with an adherent layer of a ceramic composition which comprises, flame spraying an alloy bond coat on said substrate, and then flame spraying a ceramic composition consisting essentially by weight of about 10 to 50% alumina and the balance essentially zirconia at least partially stabilized by a stabilizing agent ranging up to about 20% by weight of the mixture of said zirconia and said agent, said stabilizing agent being selected from at least one of the group consisting of neodymia, lanthana, yttria, calcia, and magnesia, said composition being in the form of particles selected from the group consisting of spray dried particles, agglomerated resin-bonded particles and fused particles, whereby a bonded ceramic coating is produced characterized by improved resistance to spalling at thicknesses ranging up to about 0.1 inch and higher and further characterized by being stronger and tougher than flame sprayed coatings of stabilized zirconia alone.

7. The method of claim 6, wherein the amount of alumina ranges from about 20 to 40% of the total composition.

8. The method of claim 6, wherein the ceramic coating is produced on a ferrous metal substrate.

9. The method of claim 6, wherein the stabilizing agent is calcia which combined with zirconia ranges from about 4 to 8% of the zirconia-calcia content.

10. A flame sprayed ceramic coating bonded to a metal substrate by means of a flame sprayed intermediate alloy bond coat, said flame sprayed ceramic coating consisting essentially by weight of about 10 to 50% alumina and the balance essentially zirconia, said coating characterized by improved resistance to spalling at thicknesses ranging up to 0.1 inch and higher and further characterized by being stronger and tougher than flame sprayed coatings of stabilized zirconia alone.

11. The flame sprayed ceramic coating of claim 10, wherein the amount of alumina in the coating ranges from about 20 to 40% by weight.

12. The flame sprayed ceramic coating of claim 10, wherein the metal substrate is a ferrous metal substrate.

13. A flame sprayed ceramic coating bonded to a metal substrate by means of a flame sprayed intermediate alloy bond coat, said ceramic coating consisting essentially by weight of about 10 to 50% alumina and the balance essentially stabilized zirconia, said coating characterized by improved resistance to spalling at thicknesses ranging up to 0.1 inch and higher and further characterized by being stronger and tougher than flame sprayed coatings of stabilized zirconia alone.

14. The flame sprayed ceramic coating of claim 13, wherein the amount of alumina ranges from about 20 to 40%.

15. The flame sprayed ceramic coating of claim 13, wherein the metal substrate is a ferrous metal substrate.

16. A flame sprayed ceramic coating bonded to a metal substrate by means of a flame sprayed intermediate alloy bond coat, said ceramic coating consisting essentially by weight of about 10 to 50% alumina and the balance essentially zirconia at least partially stabilized by a stabilizing agent in amounts ranging up to about 20% by weight of the mixture of zirconia and said agent, said stabilizing agent being selected from at least one of the group consisting of neodymia, lanthana, yttria, calcia, and magnesia, said coating characterized by improved resistance to spalling at thicknesses ranging up to 0.1 inch and higher and further characterized by being stronger and tougher than flame sprayed coatings of stabilized zirconia alone.

17. The flame sprayed ceramic coating of claim 16, wherein the alumina ranges from about 20 to 40% by weight of the total composition.

18. The flame sprayed ceramic coating of claim 16, wherein the metal substrate is a ferrous metal substrate.

19. A flame sprayed ceramic coating bonded to a metal substrate by means of a flame sprayed intermediate alloy bond coat, said ceramic coating consisting essentially of about 10 to 50% alumina and the balance essentially zirconia stabilized by calcia in an amount of about 4 to 8% of the combined zirconia and calcia content, said coating characterized by improved resistance to spalling at thicknesses ranging up to 0.1 inch and higher and further characterized by being stronger and tougher than flame sprayed coatings of stabilized zirconia alone.

20. The flame sprayed ceramic coating of claim 19, wherein the amount of alumina ranges from about 20 to 40% of the total composition.

21. The flame sprayed ceramic coating of claim 19, wherein the metal substrate is a ferrous metal substrate.

* * * * *